US006834783B2

(12) United States Patent
Kimura

(10) Patent No.: US 6,834,783 B2
(45) Date of Patent: Dec. 28, 2004

(54) SIZE RESTORING DEVICE

(75) Inventor: Masaki Kimura, Osaka (JP)

(73) Assignee: Asahi Garment Machinery Co., Ltd., Osaka (JP)

( * ) Notice: Subject to any disclaimer, the term of this patent is extended or adjusted under 35 U.S.C. 154(b) by 0 days.

(21) Appl. No.: 10/315,575

(22) Filed: Dec. 10, 2002

(65) Prior Publication Data

US 2003/0127473 A1 Jul. 10, 2003

(30) Foreign Application Priority Data

Dec. 11, 2001 (JP) ..... 2001-376773

(51) Int. Cl.[7] ..... D06C 15/00
(52) U.S. Cl. ..... 223/52.1
(58) Field of Search ..... 223/61, 70, 51, 223/69, 52.1, 76, 63, 65; 38/12, 13; 26/1, 87; 28/167, 245, 140

(56) References Cited

U.S. PATENT DOCUMENTS 3,739,960 A * 6/1973 Maez et al. ..... 223/73
4,584,952 A * 4/1986 Phillips ..... 112/148

* cited by examiner

*Primary Examiner*—Rodney M. Lindsey
*Assistant Examiner*—James G Smith
(74) *Attorney, Agent, or Firm*—Darby & Darby

(57) ABSTRACT

The present invention provides a size restoring device for restoring the original size of collars, front plackets, and shirt cuffs using a relatively simple structure to achieve an effective and exact restoration. Also, the present invention provides a size restoring device having holders on a baseboard. The holders hold both ends of the fabric of a shirt's collar. The holders comprise a stretcher, which stretches the fabric by moving at least one of the holders in the stretching direction, and a stretch adjuster for adjusting the distance that the holder has moved to obtain the required measurements. The present invention restores the original size of collars, front plackets, and shirt cuffs which have shrunk after being washed or the like by stretching the fabric to the original size.

7 Claims, 3 Drawing Sheets

SIZE RESTORING DEVICE

BACKGROUND OF THE INVENTION

1. Field of the Invention

The present invention provides a size restoring device for stretching and restoring the original size of fabric such as collars, front plackets, and shirt cuffs that have shrunk after being washed or the like. Fabric is restored using the size restoring device prior to finishing by ironing or the like.

2. Description of the Related Art

The conventional procedure for restoring fabric such as collars, front plackets, and shirt cuffs that have shrunk after being washed or the like includes stretching and pressing the fabric almost simultaneously with a stretcher having an upper or lower flatiron of an iron pressing machine. Thus, the fabric is stretched on the flatiron.

First, combining the flatiron of the iron pressing machine and the stretcher complicates the structure of the flatiron. However, there still remains the problem of restoring the original size of the fabric.

A shirt W, as shown in FIG. 6, has a front placket 14 with buttonholes for fastening the front buttons. Typically, an interlining is inserted into the front placket 14 for maintaining its original shape. However, since the material of the interlining and the material of the front placket 14 are different, the materials shrink differently after being washed. The front placket 14 warps and looks unattractive when the buttons are fastened, if the original size of the front placket 14 has not been restored.

Collars, front plackets, and shirt cuffs made from various materials are not the only problems that arise. There are the difference in material shrinkage and the structural differences between the stitched part of the interlining, the stitched part of the front placket, and the stitched part of the collar base. Therefore, the exact restoration of the original size is difficult when only arbitrarily stretching the fabric.

In addition to the above problems, the complex structure of the flatiron is expensive to produce and also increases the risk of mechanical failure.

SUMMARY OF THE INVENTION

The present invention provides a size restoring device that can overcome the above-mentioned problems. The present invention also provides a size restoring device that provides a precise action for stretching and restoring the fabric using a relatively simple structure.

The present invention provides a size restoring device that, for example, has holders on the baseboard for holding both ends of the fabric of a shirt's collar. A size restoring device of the present invention comprises a stretcher for stretching the fabric by moving at least one of the holders in the stretching direction. A size restoring device of the present invention also comprises a stretch adjuster for adjusting the distance that the holder has moved to obtain the required measurements. A size restoring device having the structure described above restores the original size of collars, front plackets, and shirt cuffs by stretching the collars, front plackets, and shirt cuffs that have shrunk after being washing or the like.

Furthermore, a steam releaser can be located on the center of the baseboard so that steam can be sprayed onto the fabric, thereby providing moderate moisture to the stretched fabric of the collars or the like. Thus, the fabric is stretched properly and without undue force.

The above and other objects, features, and advantages of the present invention will become apparent from the following description read in conjunction with the accompanying drawings, in which like reference numerals designate the same elements.

DETAILED DESCRIPTION OF THE PREFERRED EMBODIMENTS

Figure 4:
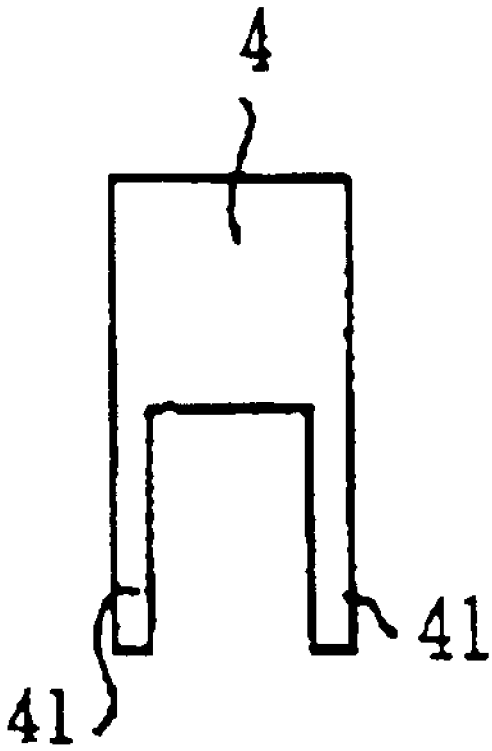
FIG. 4 is a front view of a stopper according to an embodiment of the present invention.
Figure 5:
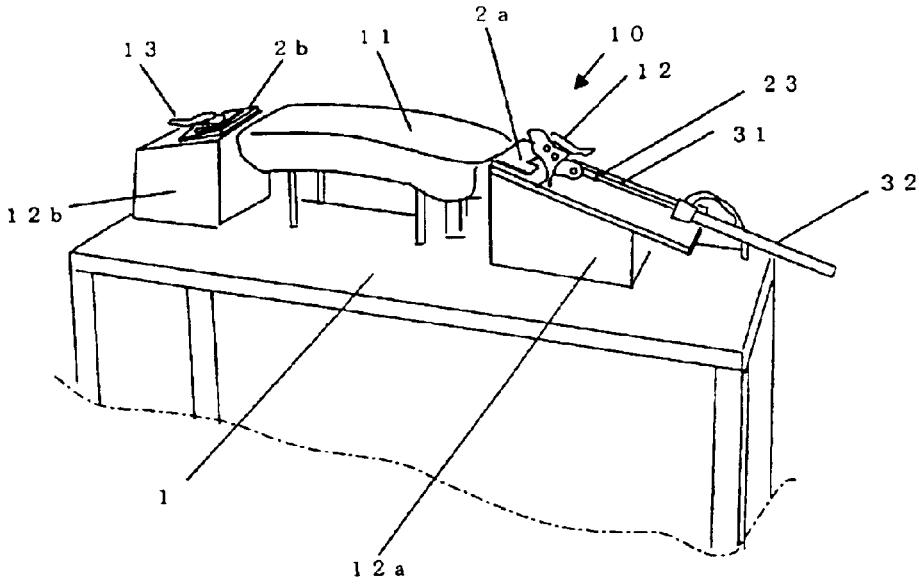
FIG. 5 is a perspective view of a size restoring device according to an embodiment of the present invention.
Figure 6:
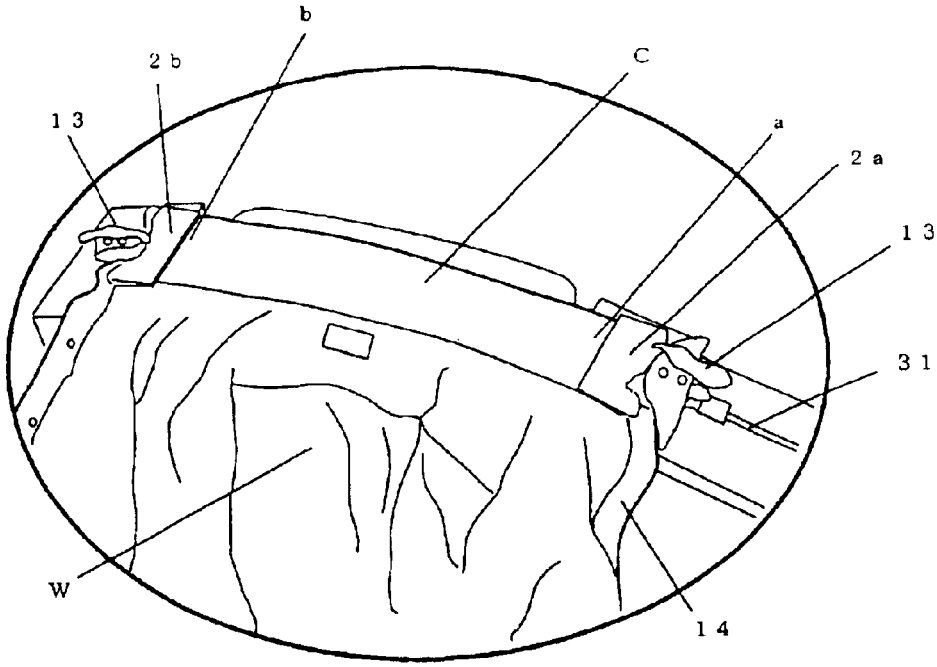
FIG. 6 is a partially expanded view of a collar held using a size restoring device according to an embodiment of the present invention.

As shown in FIG. 5, a size restoring device 10 is placed on the body of the baseboard 1. Stand members 12*a* and 12*b* are placed on the baseboard 1 at both ends of a pressing board 11 having a curved surface. As shown in FIG. 6, a holder 2*a* on stand member 12*a* holds end a of the collar C of the shirt W, while a holder 2*b* on stand member 12*b* holds the other end b of the collar C. A piston rod 31 of air cylinder 32 is connected by a joint to holder 2*a*. Actuating the air cylinder 32 stretches the collar C, which is held between holders 2*a* and 2*b*, and stretching the collar C corrects the size of the collar C which has shrunk. Further details are explained below with respect to FIGS. 1–4.

On both sides of the baseboard 1 of the a size restoring device 10, the holders 2*a* and 2*b* hold both ends of the fabric of the shirt's collar C. The back of holder 2*a* is attached to the stretcher comprised of the air cylinder 32 and the piston 31.

A guiding rail 21 is located on the bottom of holder 2*a* and slides along a guiding groove 22 located on a guiding baseboard 3 on the front stand member 12*a*. The guiding rail 21 slides holder 2*a* along the guiding baseboard 3. As the piston 31 is driven, holder 2*a* pulls one end of the collar C held in place by the holders 2*a* and 2*b*, thereby stretching the collar C.

Holder 2*b* is fixed on stand member 12*b* on the baseboard 1. Holder 2*b* fixes the other end of the collar C that is pulled by holder 2*a* on the other side of the baseboard 1, opposite from holder 2*a*. Holder 2*b* can be constructed to be able to move, similarly to holder 2*a*.

In addition, gauge graduations 33 on the guiding baseboard 3 indicate the stretching degree with respect to the material and the original size of the stretching collar C. A detachable stopper 4, as shown in FIG. 4, has a pair of legs 41 that are inserted into stopper setting holes 34 on the guiding baseboard 3. The legs 41 are positioned across the guiding groove 22. Regardless of the location of the pairs of the stopper setting holes 34 and the displacement intervals between each pair, a wall of a stopper setting hole 34 does not intersect a wall of an adjacent stopper setting hole 34 even if the holes are set close together.

The pressing board 11 has a steam releaser 5 described below which is located between the holders 2*a* and 2*b*. If necessary, the steam releaser 5 sprays steam from steam releasing holes 51 to the fabric of the collar C (including the stitched part A and the base B of the collar), which is stretched between the holders 2*a* and 2*b*, so that the fabric of the collar C is not stretched forcefully. However, the steam releaser 5 is not required.

Figure 1:
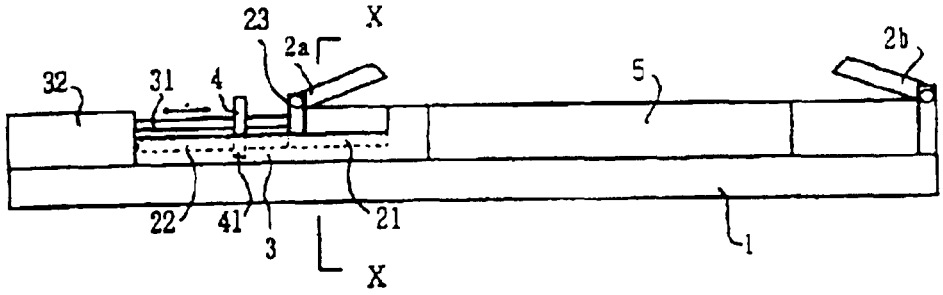
FIG. 1 is a side view of a size restoring device according to an embodiment of the present invention.
Figure 2:
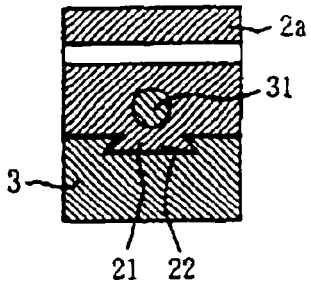
FIG. 2 is a cross-sectional view taken along the line X—X of FIG. 1.
Figure 3:
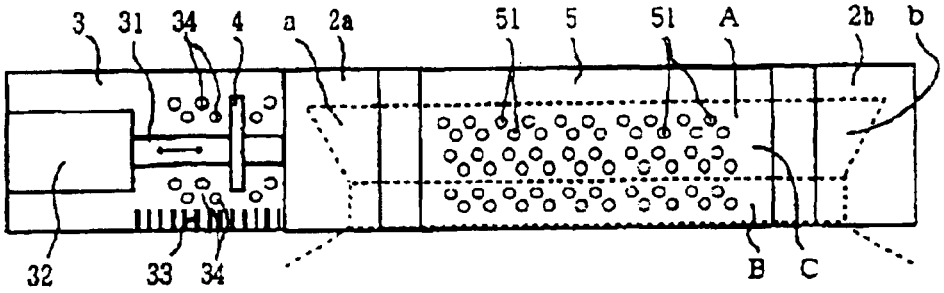
FIG. 3 is a plan view of a size restoring device according an embodiment of the present invention.

The method for using the size restoring device 10 constructed as described above is as follows. As shown in FIGS. 3 and 6, the collar C of the shirt W held between the holders 2*a* and 2*b* is unfolded and placed with one end near the side end of the guiding baseboard 3 or near the side end of the steam releaser 5. Each end a and b of the collar C is held with the holders 2*a* and 2*b*. The holders 2*a* and 2*b* are opened and shut using a handle 13. When the holders 2*a* and 2*b* are shut, the collar C is held in place by springs (not shown).

After checking the original size, the material, and the stretching degree of the collar C, the stopper 4 is inserted into the stopper setting holes 34, thereby setting the stretching degree. The stretching degree may be set in different ways. For instance, the stretching degree may be set by using software and sensors and without using the stopper setting holes 34.

When the steam releaser 5 sprays cold steam to give moderate moisture to the fabric and the air cylinder 32 is actuated, the piston 31 is pulled into the air cylinder 32. Therefore, holder 2*a* moves toward the air cylinder 32. This motion stops holder 2*a* at the position where the back surface 23 of holder 2*a* contacts the stopper 4.

Then, after the steam releaser 5 sprays hot steam to give the fabric moderate resilience and the fabric is left for a predetermined period of time, the fabric is released from the holders 2*a* and 2*b*. The process is finished with ironing, if necessary.

A simple and inexpensive size restoring device according to the present invention enables the restoration of the exact original size of a shirt's collar or the like which has shrunk after being washed or the like. Also, a size restoring device according to the present invention can stretch and adjust the collar to avoid having to wear a collar that has been shrunk and is too tight or sprawled. The present invention also restores the original size of front plackets and shirt cuffs.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A size restoring device comprising:

a plurality of holders for holding both ends of a fabric;

a stretcher adapted to stretch said fabric by moving at least one of said holders in a stretching direction of said fabric;

a stretch adjuster adapted to adjust the distance that said holder is moved, said stretch adjuster being adapted to set a stretching degree with respect to a material of said fabric and an original size of said fabric; and at least one releaser adapted to spray steam onto said fabric stretched with said stretcher.

2. A size restoring device according to claim 1, wherein:

said stretcher comprises an air cylinder and a piston actuated by said air cylinder, wherein said piston is connected to one of said holders to move said holder.

3. A size restoring device according to claim 1, further comprising:

a baseboard, and at least one guiding rail on said baseboard, wherein said holder moves by sliding on said guiding rail.

4. A size restoring device according to claim 3, wherein said other holder is stationary with respect to the baseboard.

5. A size restoring device according to claim 3, wherein said stretch adjustor comprises a plurality of stopper setting holes in said baseboard and a stopper.

6. A size restoring device according to claim 3, further comprising a pressing board on said baseboard and positioned between said holders.

7. A size restoring device according to claim 1, wherein the stretch adjuster is adapted to adjust the distance that said holder is moved in said stretching direction of said fabric.

* * * * *